US009017549B2

(12) United States Patent
Perham

(10) Patent No.: US 9,017,549 B2
(45) Date of Patent: Apr. 28, 2015

(54) DEBRIS CATCHING DEVICE FOR SURGE TANKS IN SWIMMING POOL CIRCULATION SYSTEMS

(76) Inventor: Robert Perham, Boca Raton, FL (US)

( * ) Notice: Subject to any disclaimer, the term of this patent is extended or adjusted under 35 U.S.C. 154(b) by 417 days.

(21) Appl. No.: 13/548,596

(22) Filed: Jul. 13, 2012

(65) Prior Publication Data

US 2013/0015111 A1 Jan. 17, 2013

Related U.S. Application Data

(60) Provisional application No. 61/508,134, filed on Jul. 15, 2011.

(51) Int. Cl.
*E04H 4/12* (2006.01)

(52) U.S. Cl.
CPC ..... *E04H 4/1209* (2013.01)

(58) Field of Classification Search
CPC ..... B01D 29/0029; B01D 29/0034; B01D 29/0036; B01D 29/0063; E04H 4/1209
USPC ..... 210/167.1, 232, 459, 470, 471
See application file for complete search history.

(56) References Cited

U.S. PATENT DOCUMENTS

| | | | | |
|---|---|---|---|---|
| 3,969,248 | A | 7/1976 | Whitmer | |
| 4,627,118 | A * | 12/1986 | Baker | 4/510 |
| 5,385,666 | A * | 1/1995 | Perlsweig | 210/238 |
| 5,979,106 | A | 11/1999 | Butler | |
| 6,358,405 | B1 * | 3/2002 | Leahy | 210/85 |
| 6,379,541 | B1 | 4/2002 | Nicholas | |
| 6,684,562 | B1 | 2/2004 | Schade | |
| 2003/0196950 | A1 | 10/2003 | Kraft | |
| 2011/0284442 | A1 * | 11/2011 | Williams | 210/170.09 |

* cited by examiner

*Primary Examiner* — Fred Prince
(74) *Attorney, Agent, or Firm* — Robert M. Downey, P.A.

(57) ABSTRACT

A debris catching device for surge tanks in swimming pool circulation systems prevents debris from building up within a surge tank. The debris catching device includes a net member for capturing the debris before it enters the surge tank and an elongate main body that is adjustably extendable to select lengths for proper installation. A drawstring cord extending through the length of the elongate main body and around the lining of the net member is provided for cinching the net member closed around the exterior of the gutter drain pipe so that the captured debris doesn't spill out of the net and into the surge tank. A support cord attached to the elongate main body and having opposite ends attached to the lining of the net member may be used for holding the net member in an upright position.

13 Claims, 6 Drawing Sheets

DEBRIS CATCHING DEVICE FOR SURGE TANKS IN SWIMMING POOL CIRCULATION SYSTEMS

BACKGROUND OF THE INVENTION

This non-provisional application is based on provisional patent application Ser. No. 61/508,134 filed on Jul. 15, 2011.

FIELD OF THE INVENTION

The present invention relates to swimming pool filtration systems and, more particularly, a debris catching device for filtering debris from water being directed into the surge tank of a swimming pool circulation system.

DISCUSSION OF THE RELATED ART

Surge tanks are commonly used in the circulation systems of commercial swimming pools as a means for storing water that is displaced by swimmers or otherwise spills over into a gutter around the periphery of the pool. From the surge tank, the water is filtered and re-circulated into the swimming pool. A surge tank typically holds a gallon of water for every square foot of pool surface area, and a float valve ensures that the water level in the surge tank stays below a designated level as the displaced water enters the surge tank. When the maximum water level is reached, the filter pump will take on the water from the gutter and filter it before the water is directed back into the swimming pool.

A significant amount of debris can accumulate in the surge tank within a short period of time, requiring that the surge tank be drained and cleaned as many as three times per week, a process that requires upwards of 30 minutes each time. While certain filtering devices are fixtures in residential and commercial swimming pool systems, there remains a need for a debris catching device that is specifically adapted for use in conjunction with a surge tank that limits the amount of debris that accumulates within the surge tank, thereby reducing the amount of time required to clean the surge tank, filter(s) and main pump.

OBJECTS AND ADVANTAGES OF THE INVENTION

Considering the foregoing, it is a primary object of the present invention to provide a debris catching device for surge tanks in swimming pool circulation systems that captures debris upon entering the surge tank, thereby preventing fouling and clogging of the filter(s) and main pump and reducing the need to empty and clean the surge tank.

It is a further object of the present invention to provide a debris catching device for surge tanks that can be easily installed to the end of the gutter drain pipe within the surge tank.

It is a further object of the present invention to provide a debris catching device for surge tanks that is easy to empty, clean and reinstall.

It is a further object of the present invention to provide a debris catching device for surge tanks that is inexpensive to manufacture.

It is still a further object of the present invention to provide a debris catching device for surge tanks that is comprised of corrosion-resistant materials.

These and other objects and advantages of the present invention are readily apparent with reference to the detailed description and accompanying drawings.

SUMMARY OF THE INVENTION

The present invention is directed to a debris catching device for surge tanks (i.e. holding tanks) in swimming pool circulation systems. In swimming pools, as displaced water enters the gutter and is directed to the surge tank utilizing gravity, debris from the swimming pool is carried with the water before entering the surge tank. The debris catching device is adapted for attachment onto the gutter drain pipe that directs displaced swimming pool water into the surge tank, and includes a net member for capturing the debris that exits the gutter drain pipe, thereby preventing a buildup of debris in the surge tank. An elongate main body comprised of inner and outer pipe portions allows the debris catching device to be extended to varying lengths as required for proper installation along the gutter drain pipe. A drawstring mechanism extending through the length of the elongate main body and within a top rim lining of the net member is provided for reducing the diameter of the top opening of the net. This allows the top opening of the net member to be cinched tight and closed around the exterior of the gutter pipe so that debris captured in the net member does not spill out into the surge tank. Debris catching devices having net members of larger diameters (i.e. 15 inch diameter), may require a support cord attached to the elongate main body and having opposite ends attached to the lining of the net member for holding the net member in an upright position.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
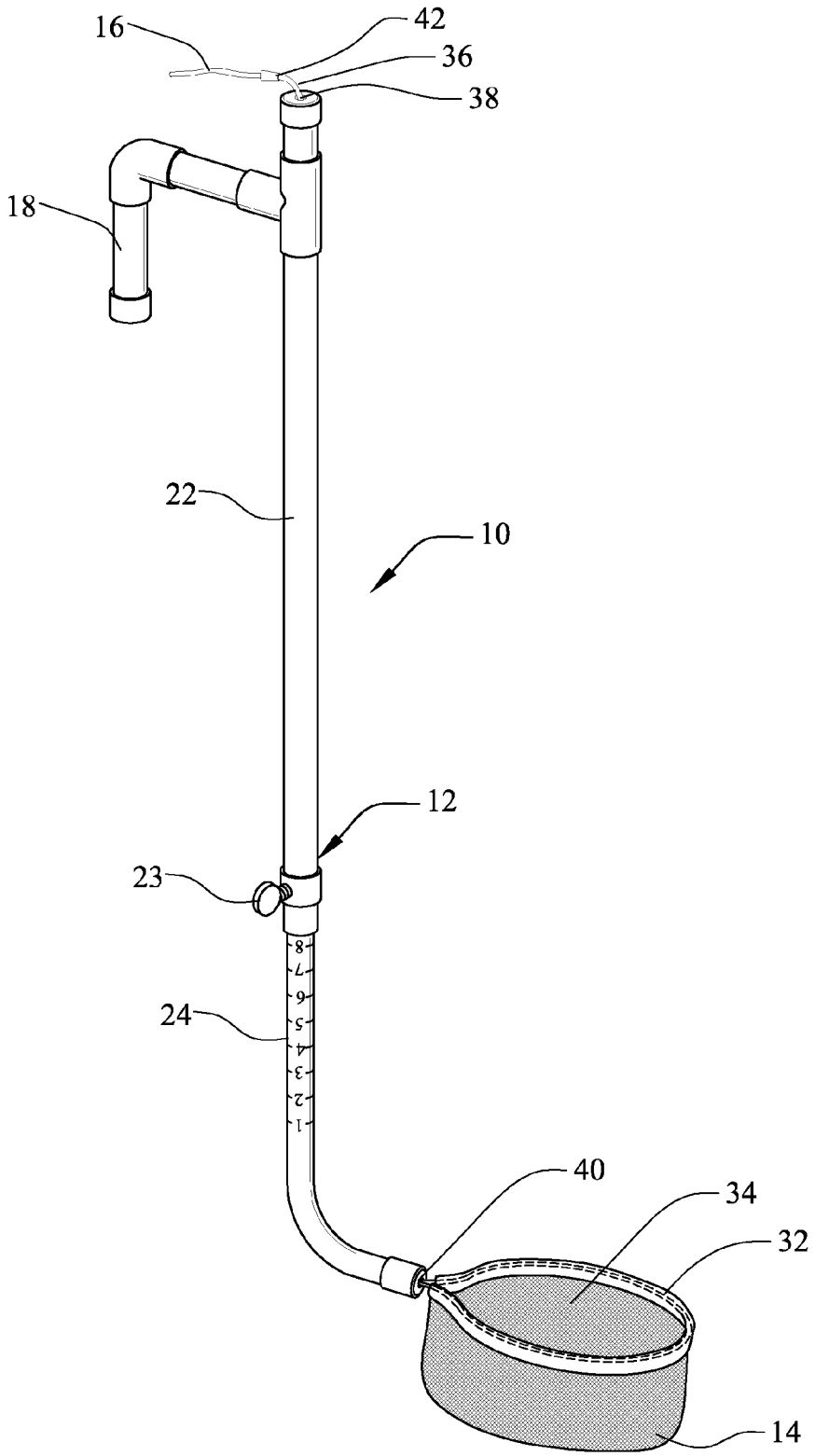
FIG. 1 is a perspective view of the debris catching device of the present invention, illustrating a net member located on the bottom end of an elongate main body and a drawstring in communication with the net member extending through the length of the elongate main body and extending out of the top end of the main body.
Figure 2:
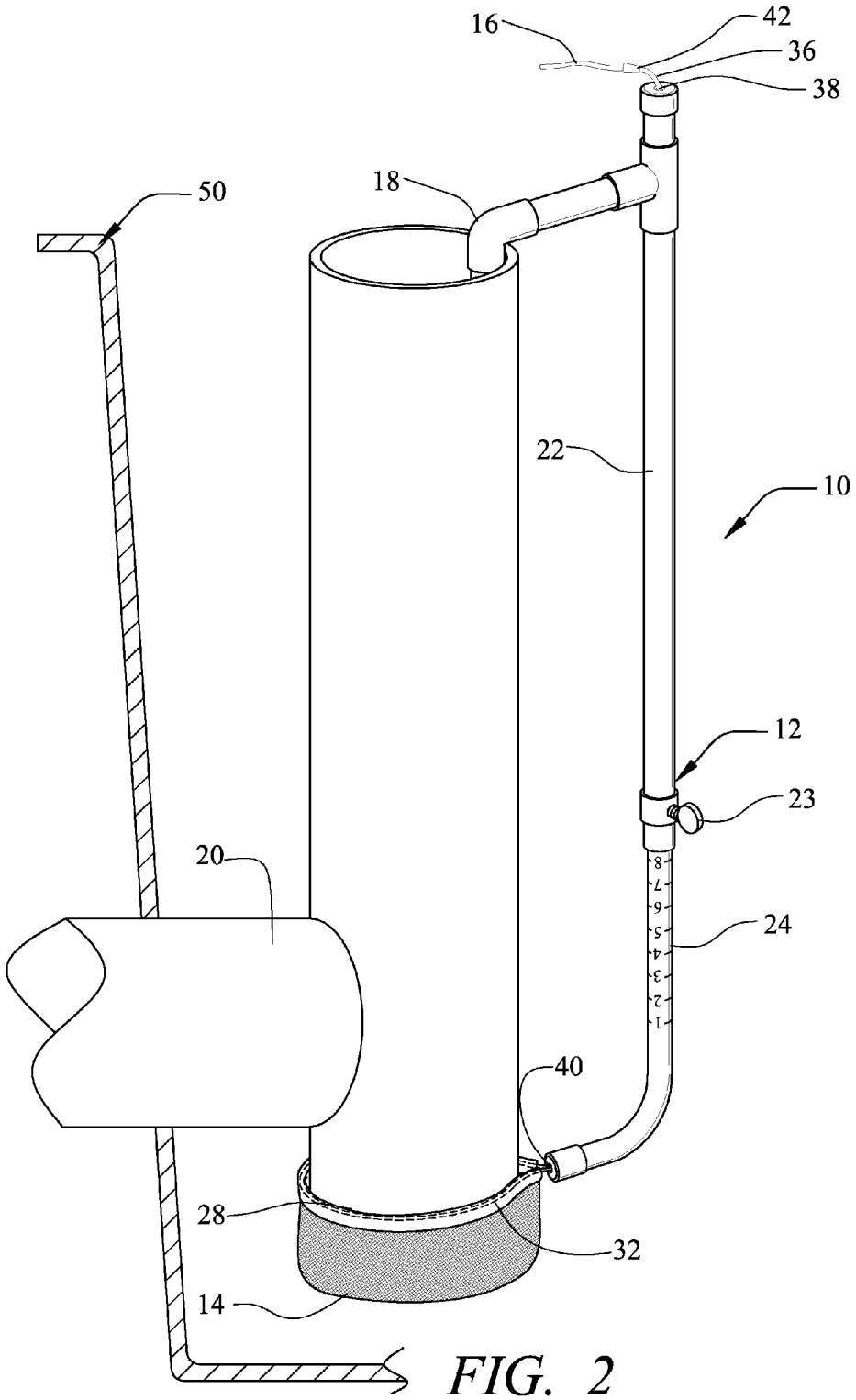
FIG. 2 is a perspective view of the debris catching device of the present invention installed on the top side of the gutter drain pipe.
Figure 3:
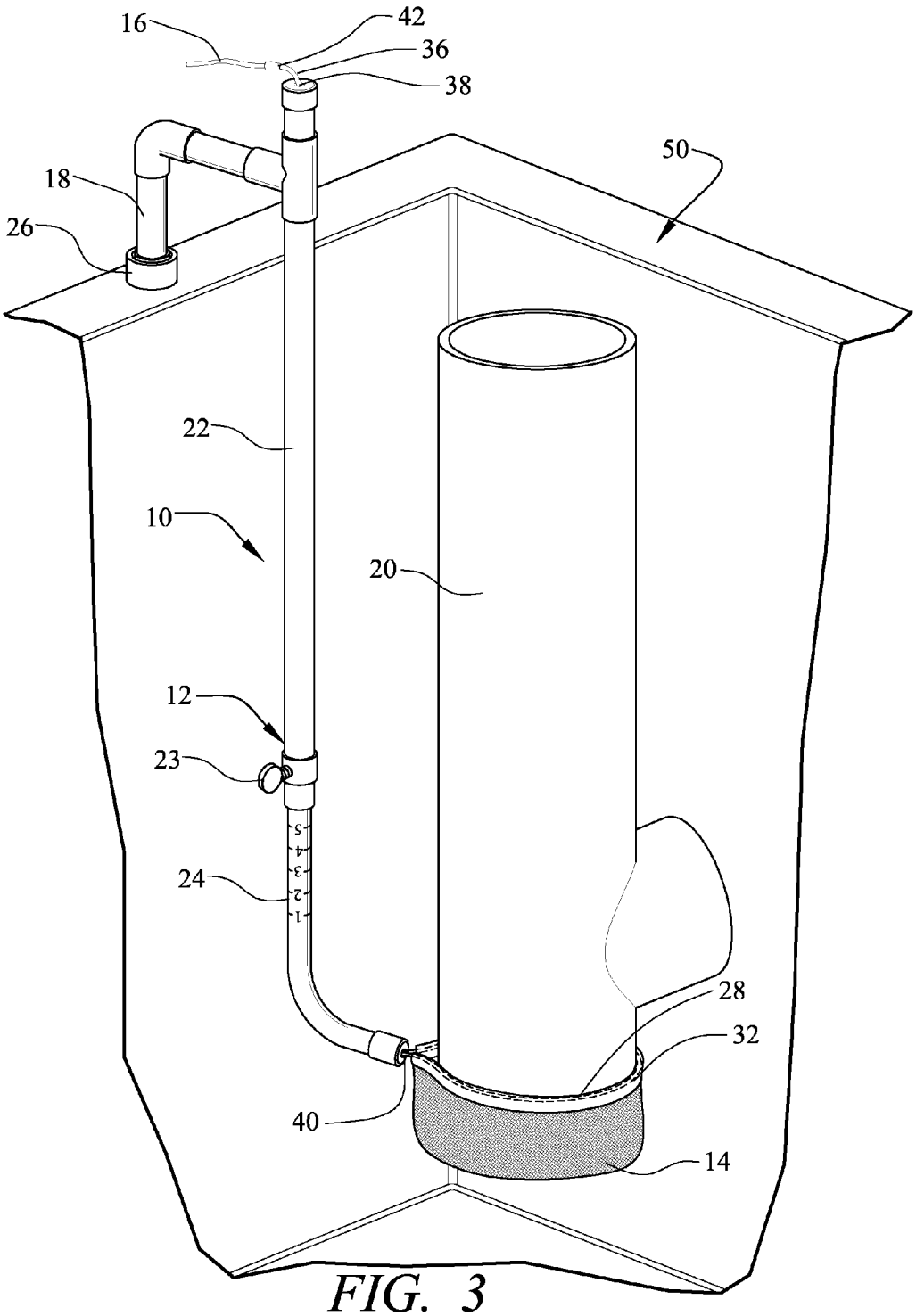
FIG. 3 is a perspective view of the debris catching device of the present invention, illustrating an alternate means of attachment to the surge tank, wherein the device is installed along a side of the surge tank using an attachment piece.

Referring to the several views of the drawings, and initially FIGS. 1-3, the debris catching device for surge tanks in swimming pool circulation systems is shown and is generally indicated as 10. The debris catching device 10 is specifically adapted for installation within a surge tank 50 and for catching debris upon entry into the surge tank 50 via the swimming pool circulation system.

A debris catching device 10 includes an elongate main body 12, a net member 14, and a drawstring mechanism 16. An L-shaped member 18 extends from the side of the elongate main body 12 and is sized for insertion within an open top side of the gutter drain pipe 20 for securing the debris catching device 10. The elongate main body 12 is preferably comprised of an upper tube 22 and a lower tube 24, wherein the upper tube 22 is sized for sealed engagement with the inner face of the lower tube 24, and allowing the user to extend and retract the elongate main body 12 as may be required for installation of the debris catching device 10 in a particularly designed surge tank 50. A thumb screw 23 may be tightened to secure the lower tube 24 in place at a particular location within the upper tube 22. To extend or retract the elongate main body 12, the thumb screw 23 may be loosened, thereby releasing the lower tube 24 to move freely within the upper tube 22.

Figure 4:
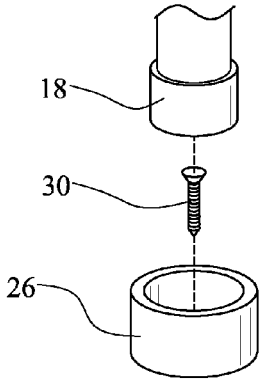
FIG. 4 is a perspective view of the attachment piece for securing the debris catching device to the surge tank.

An alternate method for attachment of the debris catching device 10 is provided as illustrated in FIGS. 3 and 4. In surge tanks 50 where the L-shaped member 18 cannot be properly inserted into an open top side of the gutter drain pipe 20, an attachment piece 26 that is sized to receive the L-shaped member 18 may be secured to a location on the surge tank 50 that permits the net member 14 to be properly positioned beneath the gutter drain pipe opening 28. The attachment piece 26 may be secured to the surge tank using a fastening member 30, such as a screw.

Figure 5:
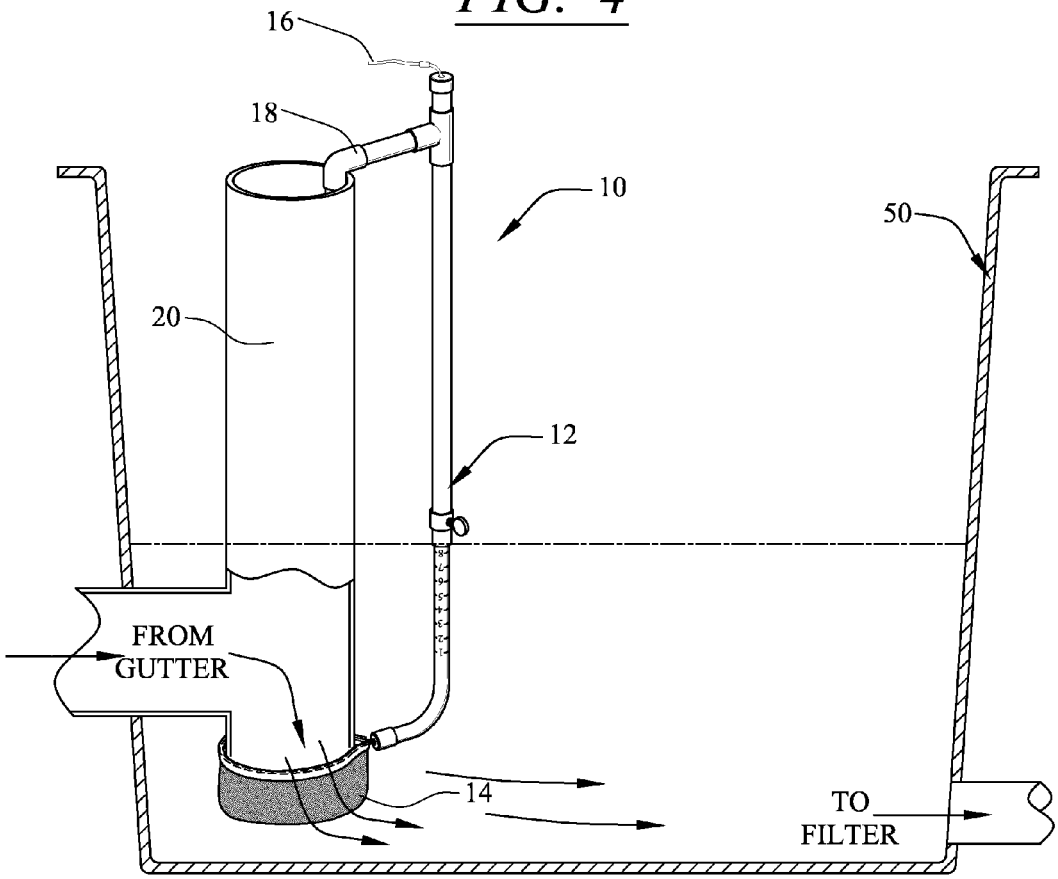
FIG. 5 is a schematic diagram illustrating the flow of water and debris in the swimming pool circulation system having an installed debris catching device.

In operation, as water and debris enter the surge tank 50 via the gutter drain pipe 20, the debris is captured within the net member 14 in position beneath the gutter drain pipe opening 28. As illustrated in FIG. 5, the debris remains in the net member 14 as the water fills the surge tank 50 prior to being filtrated and returned to the swimming pool.

Figure 6:
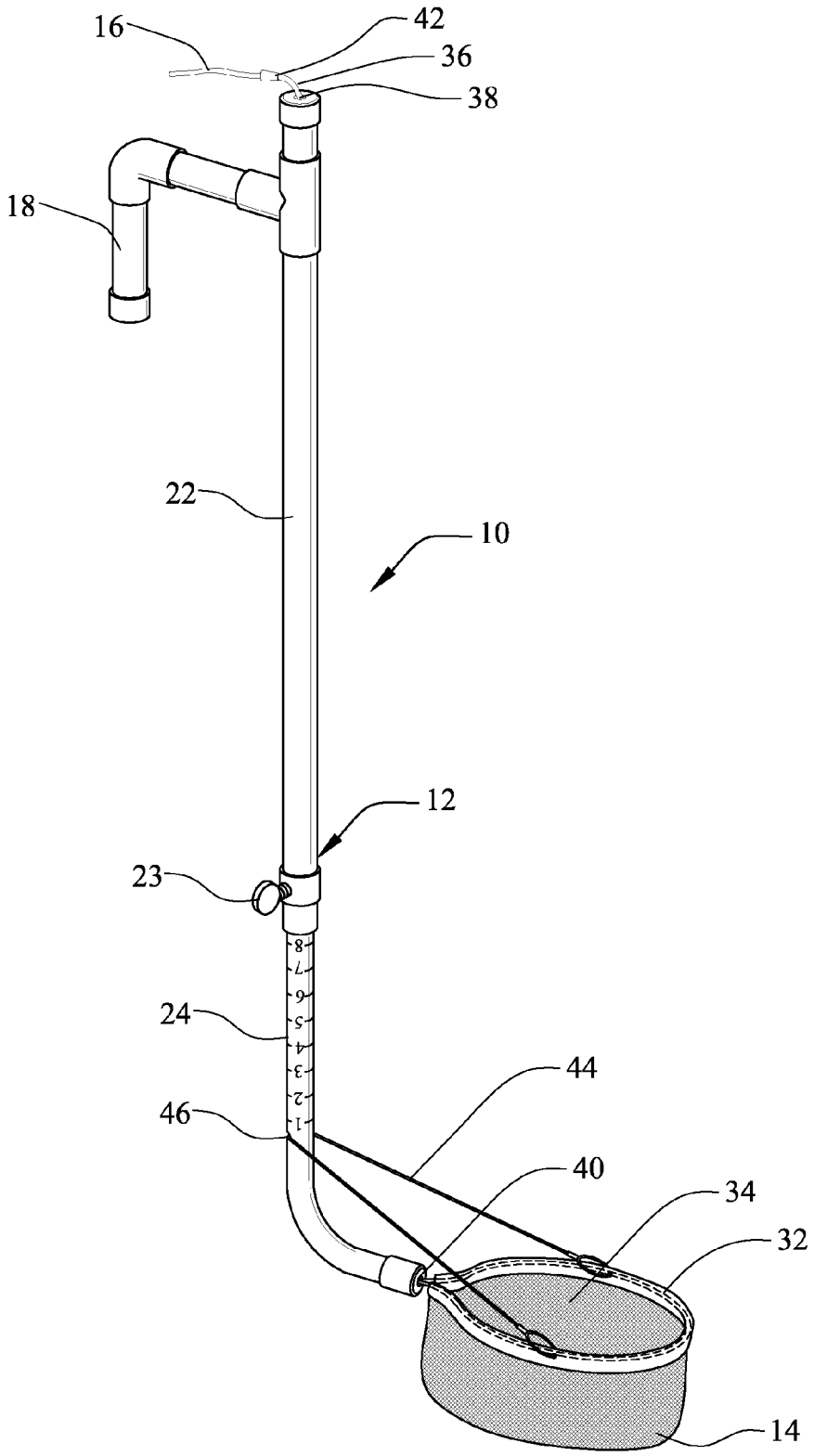
FIG. 6 is a perspective view of the debris catching device of the present invention according to an embodiment, illustrating a support cord for supporting the net in an upright position to prevent the net from collapsing due to the weight of the net and any debris contained therein.

Referring to FIG. 6, for net members having larger openings 34, opposite ends of a support cord 44 are attached to the lining 32 of the net member 14 and a midpoint of the cord 44 is held in place at notch 46 on the elongate main body 12. The support cord 44 prevents the net member 14 from inadvertently collapsing and spilling the debris content held therein. In a preferred embodiment, a support cord 44 is used for net members 14 having an opening 34 of approximately 15 inches or more, but may be used for net members 14 of all diameter sizes.

Figure 7:
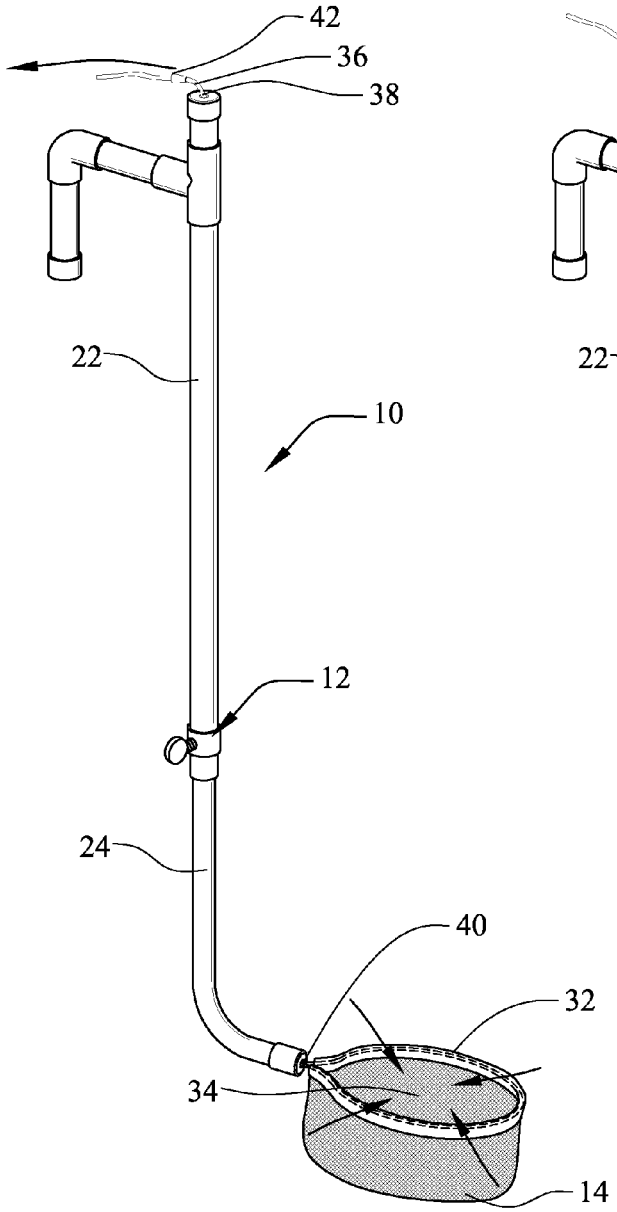
FIGS. 7 and 8 are perspective views of the debris catching device, illustrating the method for using the drawstring mechanism to reduce the diameter of the lining of the net member for securing the net member to the gutter drain pipe and then locking the lining into place using the cord lock located on the top segment of the drawstring.
Figure 8:
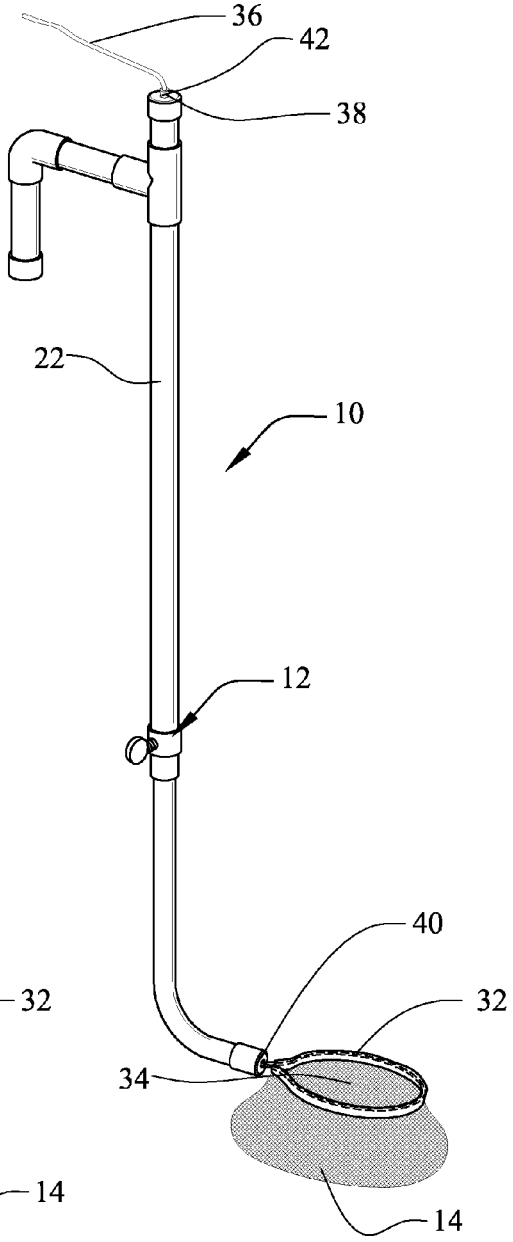

Referring to FIGS. 7 and 8, the drawstring mechanism 16 extends throughout the length of the elongate body member 12 and through the lining 32 of the net member 14, which permits the diameter of the opening 34 of the net member 14 to be expanded and reduced. To reduce the diameter of the opening 34, a top segment 36 of the drawstring mechanism 16 may be pulled through the top opening 38 of the elongate main body 12, which causes a portion of the drawstring mechanism 16 to enter the bottom opening 40 of the elongate main body 12, thereby reducing the diameter of the lining 32, and hence the diameter of the opening 34. A cord lock 42 is provided along the top segment 36 of the drawstring mechanism 16, which may be positioned against the top opening 38 to lock the exposed portion of the lining 32 into place. The diameter of the exposed portion of the lining 32 may be expanded by pulling the cord lock 42 away from the top opening 38, and then pulling the lining 32 through the bottom opening 40. When the lining 32 is of the desired diameter, the cord lock 42 may be positioned against the top opening 38 to lock the exposed portion of the lining 32 into place.

The diameter of the opening 34 must be larger than the diameter of the drain pipe opening 28 to allow the net member 14, when expanded, to fully surround the drain pipe opening 28 before being reduced to secure the lining 32 around the drain pipe opening 28. For example, for drain pipe openings 28 having a diameter between 8 to 12 inches, a net member 14 having a 15 inch diameter opening 34 is recommended, while for drain pipe openings 28 having a diameter between 4 to 8 inches, a net member 14 having a 12 inch diameter opening 34 is recommended.

While the present invention has been shown and described in accordance with several preferred and practical embodiments thereof, it is recognized that departures from the instant disclosure are fully contemplated within the spirit and scope of the present invention.

What is claimed is:

1. A debris catching device for capturing and filtering debris contained in liquid entering a surge tank through a pipe opening in a swimming pool circulation system, said debris catching device comprising:

a net member having an opening with a lining sized and structured to fit around the pipe opening;

an elongate main body member having a proximal end, a distal end, and an interior channel extending between the proximal end and the distal end comprising:

a first tube having a proximal end, a distal end and an inner surface extending between the proximal end and the distal end; and a second tube movably received within said first tube, and said second tube being disposed in sealed engagement with said inner surface of said first tube, and said second tube being movable relative to the proximal end and the distal end of said first tube;

a drawstring cord extending the length of the interior channel, and said drawstring cord having a proximal end extending through an opening at the proximal end of said elongate main body member and a distal end extending through an opening at the distal end of said elongate main body member and defining the lining of the opening of said net member; and wherein pulling the proximal end of said drawstring cord causes the opening of said net member to contract and pulling the distal end of said drawstring cord causes the opening of said net member to expand.

2. The debris catching device as recited in claim 1 further comprising an L-shaped member extending from the proximal end of said elongate man body member, and said L-shaped member being structured and disposed for supporting said debris catching device on an edifice near the pipe opening.

3. The debris catching device as recited in claim 1 further comprising a cord lock at the proximal end of said drawstring cord, said cord lock being movable relative to the proximal end and the distal end of said drawstring cord, and said cord lock being structured and disposed for releasably locking said drawstring cord in a particular position by moving said cord lock against the opening at the proximal end of said elongate main body member.

4. The debris catching device as recited in claim 2 further comprising a fastening member securable to an edifice and said fastening member having a receiving cavity sized and structured to receive a portion of said L-shaped member for supporting said debris catching device.

5. The debris catching device as recited in claim 1 further comprising a thumb screw for releasably securing said first tube to said second tube for preventing movement of said second tube within said first tube.

6. A debris catching device for capturing and filtering debris contained in liquid entering a surge tank through a pipe opening in a swimming pool circulation system, said debris catching device comprising:

a net member having an opening with a lining sized and structured to fit around the pipe opening;

an elongate main body member having a proximal end, a distal end, and an interior channel extending between the proximal end and the distal end comprising:

a first tube having a proximal end, a distal end and an inner surface extending between the proximal end and the distal end; and a second tube movably received within said first tube, and said second tube being disposed in sealed engagement with said inner surface of said first tube, and said second tube being movable relative to the proximal end and the distal end of said first tube;

a support cord attached to said elongate main body member and said support cord having opposite ends attached to the lining of the opening of said net member, and said support cord being structured and disposed for holding said net member in an upright position;

a drawstring cord extending the length of the interior channel, and said drawstring cord having a proximal end extending through an opening at the proximal end of said elongate main body member and a distal end extending through an opening at the distal end of said elongate main body member and defining the lining of the opening of said net member; and wherein pulling the proximal end of said drawstring cord causes the opening of said net member to contract and pulling the distal end of said drawstring cord causes the opening of said net member to expand.

7. The debris catching device as recited in claim 6 further comprising an L-shaped member extending from the proximal end of said elongate man body member, and said L-shaped member being structured and disposed for supporting said debris catching device on an edifice near the pipe opening.

8. The debris catching device as recited in claim 6 further comprising a cord lock at the proximal end of said drawstring cord, said cord lock being movable relative to the proximal end and the distal end of said drawstring cord, and said cord lock being structured and disposed for releasably locking said drawstring cord in a particular position by moving said cord lock against the opening at the proximal end of said elongate main body member.

9. The debris catching device as recited in claim 7 further comprising a fastening member securable to an edifice and said fastening member having a receiving cavity sized and structured to receive a portion of said L-shaped member for supporting said debris catching device.

10. The debris catching device as recited in claim 6 further comprising a thumb screw for releasably securing said first tube to said second tube for preventing movement of said second tube within said first tube.

11. A debris catching device for capturing and filtering debris contained in liquid entering a surge tank through a pipe opening in a swimming pool circulation system, said debris catching device comprising:

a net member having an opening with a lining sized and structured to fit around the pipe opening;

an L-shaped elongate main body member having a proximal end, a distal end, and an interior channel extending between the proximal end and the distal end, said L-shaped elongate main body member being structured and disposed for supporting said debris catching device on an edifice near the pipe opening, and said L-shaped elongate main body member comprising:

a first tube having a proximal end, a distal end and an inner surface extending between the proximal end and the distal end; and a second tube movably received within said first tube, and said second tube being disposed in sealed engagement with said inner surface of said first tube, and said second tube being movable relative to the proximal end and the distal end of said first tube;

a drawstring cord extending the length of the interior channel, and said drawstring cord having a proximal end extending through an opening at the proximal end of said elongate main body member and a distal end extending through an opening at the distal end of said elongate main body member and defining the lining of the opening of said net member;

wherein pulling the proximal end of said drawstring cord causes the opening of said net member to contract and pulling the distal end of said drawstring cord causes the opening of said net member to expand; and a cord lock at the proximal end of said drawstring cord, said cord lock being movable relative to the proximal end and the distal end of said drawstring cord, and said cord lock being structured and disposed for releasably locking said drawstring cord in a particular position by moving said cord lock against the opening at the proximal end of said elongate main body member.

12. The debris catching device as recited in claim 11 further comprising a fastening member securable to an edifice and said fastening member having a receiving cavity sized and structured to receive a portion of said L-shaped elongate main body member for supporting said debris catching device.

13. The debris catching device as recited in claim 11 further comprising a thumb screw for releasably securing said first tube to said second tube for preventing movement of said second tube within said first tube.

* * * * *